US005695809A

United States Patent [19]

Chadha et al.

[11] Patent Number: 5,695,809

[45] Date of Patent: Dec. 9, 1997

[54] SOL-GEL PHOSPHORS

[75] Inventors: Surjit S. Chadha, Meridian; James J. Alwan, Boise, both of Id.

[73] Assignee: Micron Display Technology, Inc.

[21] Appl. No.: 557,864

[22] Filed: Nov. 14, 1995

[51] Int. Cl.[6] ..... B05D 5/12

[52] U.S. Cl. ..... 427/64; 427/68; 427/108; 427/126.2; 427/126.3; 427/226; 427/282; 427/287; 427/380; 427/552; 427/384

[58] Field of Search ..... 427/64, 68, 226, 427/108, 126.2, 126.3, 282, 384, 287, 380, 552

[56] References Cited

U.S. PATENT DOCUMENTS

| | | | |
|---|---|---|---|
| 3,927,224 | 12/1975 | Levene | 427/64 |
| 4,617,195 | 10/1986 | Mental | 427/64 |
| 4,651,053 | 3/1987 | Kato et al. | 427/64 |
| 4,931,312 | 6/1990 | De Leeuw et al. | 427/64 |
| 5,464,566 | 11/1995 | Ito et al. | 427/64 |

OTHER PUBLICATIONS

Sol–Gel Deposition of $Tb^{3+}:Y_2SiO_5$ Cathodoluminescent Layers,Ceramic Bulletin, vol.66, No.10, pp. 1505–1509, 1987 (no mo.).

Laser processing of sol–gel coatings, Taylor et al., Journal of Non–Crystalline Solids 147&148, pp.457–462, 1992 (no mo.).

Optical, Electrical and Mechanical Characterization of Rapid Thermal Oxidation, Yarling et al., Materials Research Society, pp.331–336, 1994 (no mo.).

Preparation of Alkoxy–Derived Yttrium Vanadate, Yamaguchi et al., J. Electrochem., vol. 136,No.5,pp. 1155–1560, May 1989.

Sol–gel silicate thin–film electrode properties,Warren et al, J. Appl. Phys.69(8), pp. 4404–4408, Apr. 1991.

Laser Processing of Semiconductors–An Update, Arthurs et al., pp. 91–100, Jun. 1981.

Ion–Implanted Thin–film Phosphors Fro Full–Colored Field Emission Displys,Kalkhoran et al., Material Research Society, pp. 481–486, 1994 (no mo.).

Sol–gel derived tin oxide thin films, Park et al., Elsevier Science S. A.,pp.268–273, 1995 (no mo.).

Optical Properties of Sol–Gel Glasses doped with Organic Molecules, Dunn et al.,J. Mater. Chem.,pp. 903–913, 1991 (no mo.).

High–Resolution Phosphor Screens,Sluzky, J. Electrochem. Soc.,pp.2893–2896, Nov. 1988.

Thin Film Phosphors fro Flat Panel Displays, Wagner et al.,Phosphor Technology Center of Excellence,pp.113–114, no date.

New and Improved Phosphors for Low–Voltage Applications,Chadha et al., SID 94 Digest, pp.5154, 1994 no mo.).

*Primary Examiner*—Janyce Bell
*Attorney, Agent, or Firm*—Hale and Dorr LLP

[57] ABSTRACT

A method of manufacturing phosphor screens is disclosed. The method uses "sol-gel" for disposing a thin film of phosphor on a transparent substrate. The thin film of phosphor is applied in continuous form or in the form of an accurate dot pattern. The rastering of said dot pattern is performed either by screen printing before annealing the sol-gel, or by selective laser curing of a continuous thin film and washing off the non-cured portions. The phosphor screens are useful as monochrome or as full-color faceplates of field emission displays or cathode ray tubes.

14 Claims, 3 Drawing Sheets

SOL-GEL PHOSPHORS

GOVERNMENT RIGHTS

This invention was made with Government support under Contract No. DABT63-93-C-0025 awarded Advanced Research Projects Agency (ARPA). The Government has certain rights in this invention.

FIELD OF THE INVENTION

This invention relates to the application of sol-gel processes for making phosphor screens. More particularly, the invention relates to the preparation of thin films on substrates which are useful as faceplates of high-resolution displays, such as field emission displays (FEDs), cathode ray tubes (CRTs), vacuum fluorescent displays (VFDs), electroluminescent displays (ELDs) and plasma displays. In addition, such thin films are useful for backlighting a liquid crystal display.

BACKGROUND OF THE INVENTION

Phosphors are applied to faceplates either in powder form or in thin film form. The powder form is often used in cathode ray tubes to prepare a particle layer screen of typically between about 6 μm and 10 μm thickness on a transparent faceplate. The thin film form is often used in flat panel displays to create a thin layer of typically 2 μm thickness on suitable substrates (for example, GaAs and Si substrates). For ELDs, the thickness of the phosphor thin film is less than 1 μm. For CRTs, the thickness is about 2 micrometers. However, there are no commercially available examples of thin film phosphor based displays apart from ELDs.

Thin film phosphors are used extensively in extremely high-resolution displays. Thin film phosphors are more stable under electron beam bombardment, as their thermal stability is much higher due to improved contact area between the phosphor material and the transparent substrate. The enlarged contact area helps to dissipate the thermal energy which develops in the phosphor under electron bombardment.

Traditional ways to make thin film phosphor comprise taking inorganic hosts, or precursors, like ZnS, and a dopant, like manganese, and evaporating or sputtering them. In such processes, a host or precursor for the phosphor is applied by methods such as sputter deposition, for example, and the light-emitting dopants may be inserted by doping methods such as ion implementation. Examples of such processes are described in the following papers, all of which are incorporated herein by reference:

"High-Resolution Phosphor Screens" by Sluzky, Journal of Electrochemical Society, Nov. 1988.

"Thin Film Phosphors for Flat Panel Displays" by Wagner et al, from a Flat Panel Manufacturing Conference of 1995.

"New and Improved Phosphors for Low-Voltage Applications" by Chadha et al, SID Digest, 1994.

The first paper estimates the contribution of the phosphor screen to the overall image resolution of a cathode ray tube. A single crystal faceplate having an epitaxial phosphor layer of 2 μm thickness is capable of reproducing the electron beam size. The yttrium aluminum garnet (YAG) family of phosphors has been used in the cathode ray tubes, and liquid phase epitaxy has been used to grow the thin layer of terbium-activated YAG onto a YAG single-crystal substrate.

The second paper gives examples of thin film phosphors for use in field emission displays and electro-luminescent displays. Thin films exhibit higher maintenance and better adhesion properties than powder phosphors. The applied phosphor materials are ZnO, ZnS, $Y_2O_3$:Eu and YAG:Tb. All of the phosphor screens are produced by some variation of chemical vapor deposition (CVD), including molecular beam epitaxy, plasma-assisted CVD, and hot wall CVD. The chemical vapor deposition typically requires a very high temperature, beyond 500° C., with only few variations allowing for lower deposition temperatures. The thickness of the films ranges from 0.2 μm to 3.0 μm.

The third paper describes chemical vapor deposition (CVD) using aerosol spray pyrolysis (ASP). The aerosol was performed by spraying a solution of the organo-metallic precursors into a large reservoir. The fine mist was led to a reaction chamber held at 450°–470° C. where it decomposed at the substrate surface. Films up to 2.5 μm were grown on sapphire or quartz substrates. These were subsequently annealed in controlled atmospheres at temperatures up to 1200° C., depending on the phosphor.

Unfortunately, thin film phosphors require extremely high deposition and/or annealing temperatures. Thus, they are not considered useful for transparent substrate FEDs, because the transparent substrate melts down at a temperature below the annealing temperature.

Another drawback of these thin film processes is non-uniformity of the phosphor dopant in the precursor. This non-uniformity results in a poor image on the phosphor screen.

SUMMARY OF THE INVENTION

It is an object of the present invention to fabricate a full color thin film phosphor screen at moderate temperatures.

It is a further object of the present invention to yield a homogeneous coating of the phosphor dopant.

It is yet another object of the present invention to structure the thin film in an accurate raster of picture elements.

One embodiment of the present invention comprises the use of sol-gel techniques to make a phosphor screen. As used herein, "sol-gel" refers to hydroxylation and condensation of the molecular precursors. In general, the sol-gel process relies on the metal alkoxides, M(OR)n where M can be Si, At, B, P, etc., and R is often an alkyl group such as $CxH_2x+1$ as mononumeric oxide precursors. In an alcohol, the alkoxide is hydrolysed by the addition of water causing the replacement of alkoxy groups (OR) with the hydroxyl groups (OH) as exemplified below:

$$Si(OR)_4+H_2O \ldots (OR)_3SiOH+ROH$$

Subsequently, the hydroxyl groups condense leading to the formation of inorganic polymers.

$$(OR)_3SiOH+HOSi(OR)_3 \ldots (OR)_3Si—O—Si(OR)_3+H_2O$$

The use of sol-gel is advantageous over the aforementioned methods with respect to the temperatures which are needed for the deposition and/or annealing steps. For instance, inorganic precursors that carry the dopant do not come off or evaporate until high temperatures are reached. The sol-gel process of one embodiment of the present invention uses an organic precursor to make a very thin film of phosphor. When heated, the organics are driven off at low temperatures leaving the inorganic dopant in uniform distribution throughout the phosphor lattice.

Also with sol-gel, a homogeneous mixture of chemicals is provided. An excellent uniformity of phosphor dopants is attained and preserved when the gel is deposited in a thin film and subsequently heated to drive off the organic residues. According to another embodiment of the invention, a process for manufacturing display screens is provided, the process comprising forming a solution of an organo-metallic precursor for the lattice and a luminescent dopant. The organo-metallic precursor in the solvent is hydrolyzed to form a gel. The gelated solution is deposited on a substrate which is preferably transparent (for example, glass) to form an electron-sensitive phosphor screen which may be excited by electrons, UV radiation or other forms of energy. The deposition on said substrate is then dried and partly removed; specifically, the organic portion of the organo-metallic precursor and said solvent are removed by application of heat and/or vacuum.

Various embodiments of the present invention allow for substantial variations, e.g., the deposition takes the form of coating a continuous thin film or printing a predetermined raster of picture elements on said substrate. According to another embodiment, the heat of the removing step is applied simultaneously to all portions of the substrate, by annealing or firing, or is applied in a selective pattern by a laser spot. A still further embodiment is manufactured with a monochrome phosphor or is repeated with other luminescent dopants to result in a full-color triad of picture elements.

BRIEF DESCRIPTION OF THE DRAWINGS

The present invention will be better understood from reading the following description of non-limitative embodiments, with reference to the attached drawings, wherein.

(a) $Y_3(Al,Ga)5012:Tb$ as an example of green emission;

(b) $Y_2O_3:Eu$ as an example of red emission; and (c) $Y_2SiO_5:Ce$

Figure 4:
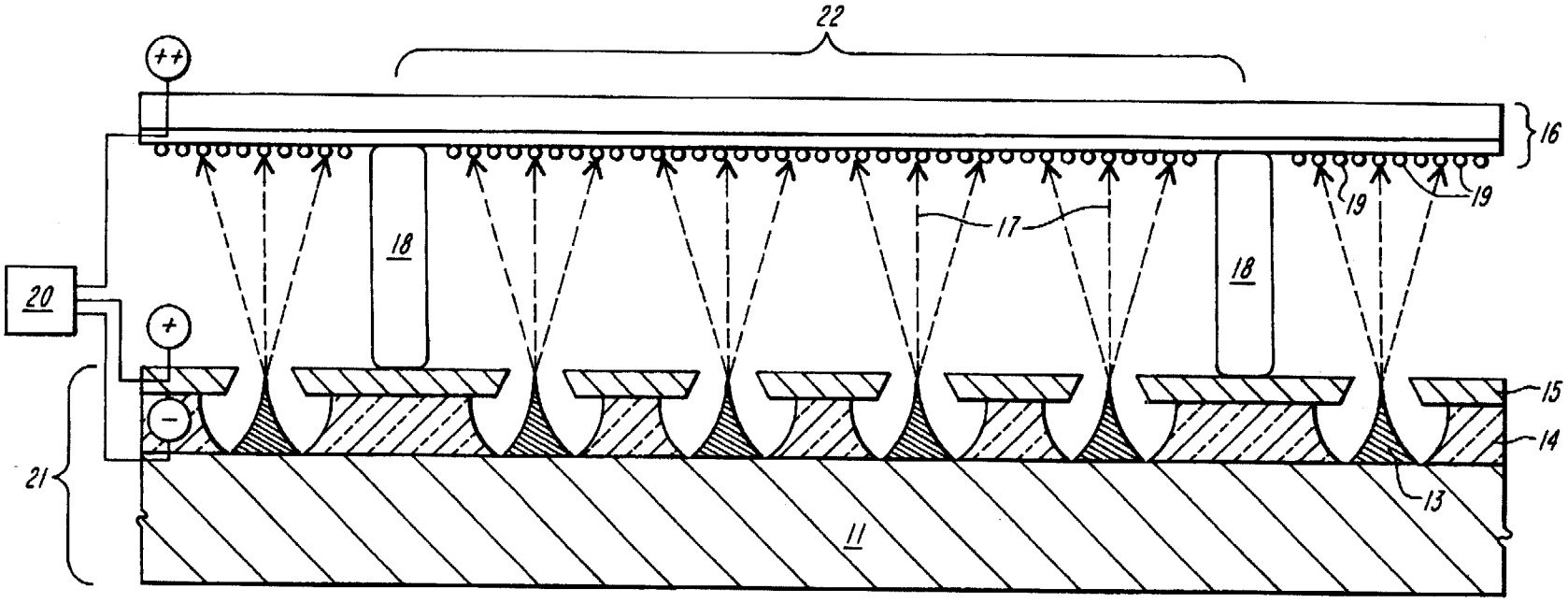

FIG. 4 is an enlarged cross-sectional view of a portion of a field emission display (FED), applying a phosphor screen according to the present invention.

DETAILED DESCRIPTION

Figure 1:
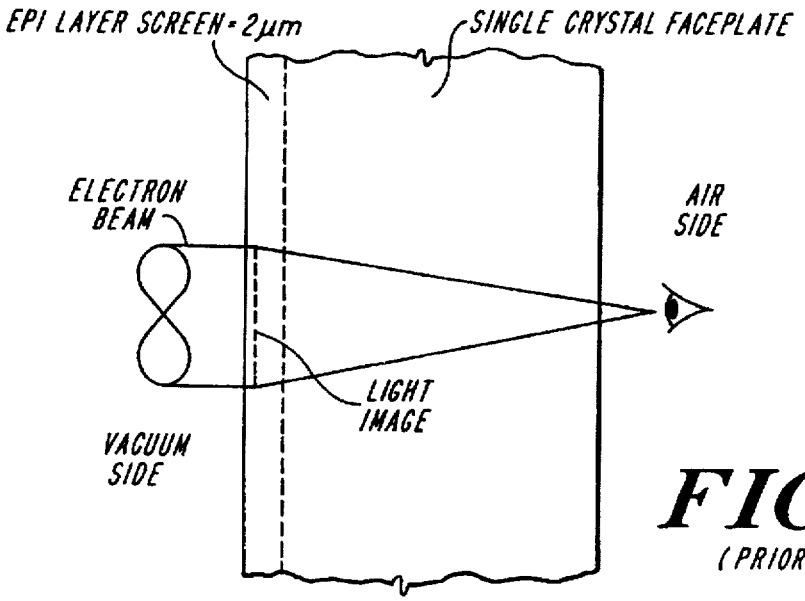
FIG. 1 (PRIOR ART)
FIG. 1 is a simplified representation of a previous single crystal faceplate having a thin luminescent epitaxial layer.

Referring now to FIG. 1, an example of a thin film phosphor screen as manufactured by a previous method is shown. A layer of 2 μm has been deposited by epitaxy on a transparent faceplate. The faceplate has a vacuum side and an air side. An electron beam impinges from the vacuum side and stimulates a light spot having a diameter of about 2 micrometers.

The principal reasons for using thin films according to FIG. 1 are:

(1) No scattering of the emitted light occurs as would be the case in a 6 μm particle layer applying the phosphor in powder form. Thus, considerable improvement of image resolution is attained.

(2) The thin film deposited on the faceplate is mechanically and thermally more stable than a powder application.

(3) The layer is thin enough to allow sufficient conduction of said electrons to prevent charging, so that nonconductive phosphors for low voltage applications are useable.

(4) No organic or inorganic binders which may contaminate the phosphor screen are needed. These binders can damage phosphors in some cases and contain mobile ions in others such as Kasil. The mobile ions can damage the circuitry of a FED.

(5) Very short annealing times are necessary. For powder phosphors, the steps involved are numerous, such as long mixing of chemicals, precipitation, milling, drying, firing, sieving, etc.

(6) Very high purity phosphors can be prepared free from contaminants which are unfortunately added whenever mixing, milling or firing at high temperatures are involved. No other chemicals need to come into contact when using sol-gel.

(7) Thermal annealing can be carried out at much lower temperatures. For example, thin films of ZnS:Mn for EL are luminescent if heated to 200° C. or above with a maximum of 500° C. normally. Powder ZnS:Mn phosphor needs to be annealed at 950° C. or above and can be 1100° C.

(8) Thin black film of another material can be placed behind the phosphor film when high energy electrons are used in either CRT or high voltage FEDs, yielding very high contrast. This aspect, i.e., contrast, is one of the biggest problems with white powder phosphored displays.

Also, the sol-gel approach of the present invention contemplates attainment of a thin film at lower temperatures and with a more uniform phosphor distribution. Some sol-gel processes are known for use in other applications. However, it is unknown in the preparation of FED displays. The sol-gel process is a chemical synthesis for preparing gels, glasses and ceramic powders. It enables one to prepare glasses at far lower temperatures than is possible by using conventional melting. Compositions Which are difficult to obtain by conventional means can be produced. In addition, the sol-gel method is a high-purity process which leads to excellent homogeneity. The sol-gel approach is adaptable to producing bulky pieces as well as films and fibers.

Even further, very short annealing times are needed. For powder phosphors, the steps involved are numerous, and include the long mixing of chemicals, precipitation, milling, drying, firing, sieving, etc. The present invention avoids these problems.

Even further still, with the present invention, thin black film or another material can be placed behind the phosphor film. Contrast is a large problem with white powder phosphored displays.

A paper of Dunn et al describes preparation of bulky glasses by using the sol-gel process (Optical Properties of Sol-Gel Glasses doped with Organic Molecules, J. Mater. Chem., 1991, 1(6), 903–913), incorporated herein by reference. The glass bodies are doped with organic molecules to provide for specific optical properties useful in optical information processing, optical data storage, optical wave guides, optical sensors, and photochemical conversion of solar energy. This known sol-gel process is divided into the steps of forming a solution, gelation, drying and densification.

Figure 2:
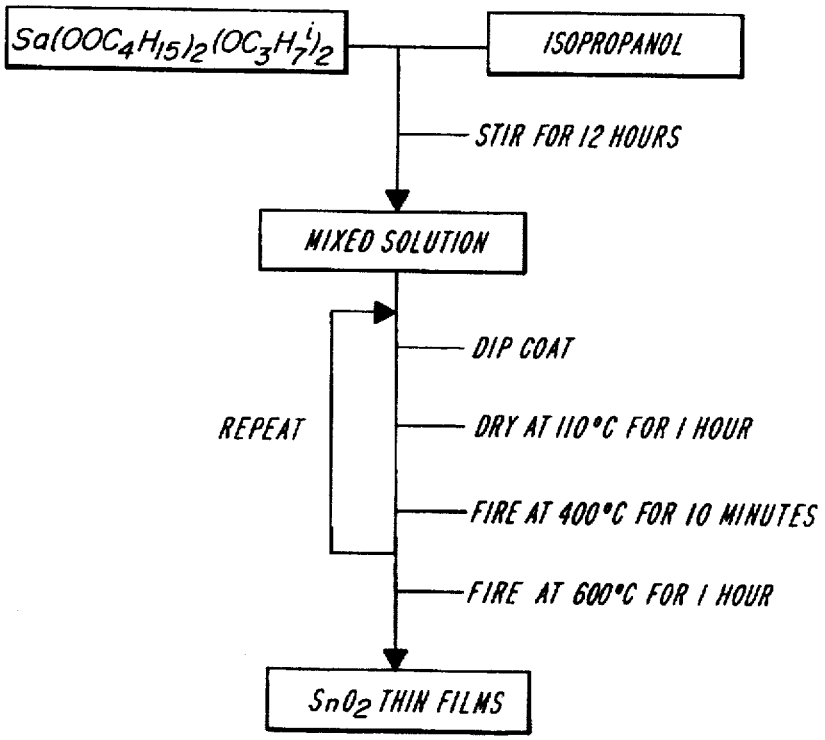
FIG. 2 (PRIOR ART)
FIG. 2 is a schematic flowchart of a preparation of $SnO_2$ thin films according to a previous sol-gel method.

A further application of the sol-gel process is the preparation of thin films of tin oxide, said films having a thickness of 0.8 to 1.1 μm. Such tin oxide films are useful in the fabrication of transparent conducting electrodes. For example, see Park, et at. (Sol-gel derived tin oxide thin films, Thin Solid Films 258 (1995) 268–273), incorporated herein by reference. The thin film of tin oxide is coated on a quartz substrate by dipping the quartz substrate into the mixed solution of sol-gel. This process is schematically depicted in FIG. 2. The sol-gel is composed of tin(IV)ethylhexano-isopropoxide and the solvent isopropanol and is mixed for 12 hours. The cleaned substrates are dipped into the mixed solution using various withdrawal speeds. The gel films are dried at 110° C. for 1 hour in air. To make multi-dipped films, the dried films are fired at 400° C. for ten minutes in air and again dipped into the solution. The procedure is repeated to obtain the desired film thickness. Finally, all films are fired at 600° C. for 1 hour in air.

In yet another process, tetraethylorthosilicate is used as a precursor and is doped with yttrium acetylacetonate and cerium acetylacetonate. This composition is dissolved in a solvent (for example, alcohol), mixed and dried.

According to one example embodiment of the present invention, a sol-gel process is used for producing thin films of phosphors on a screen or a faceplate. The basic steps in this specific application of sol-gel methods are to form a solution of an organo-metallic precursor and a luminescent dopant in a solvent, to hydrolyze the organo-metallic precursor so that a gelatine is formed, to deposit the gelated solution onto a transparent substrate, to dry the deposited gelated solution on said substrate, and to anneal or otherwise heat the thin film on the substrate in order to remove the organo-metallic precursor and the solvent.

The result is a homogeneous layer of the luminescent film on the transparent substrate. Basically, all phosphors that are traditionally used with cathode ray tubes and flat panel displays are possible candidates for the sol-gel process of the present invention.

In one example embodiment of the present invention, phosphors for low-voltage applications are employed. One or more phosphors are doped simultaneously or consecutively. Normally, one phosphor results in a monochrome display, whereas three phosphors emitting red, green and blue result in a full color display.

Figure 3A:
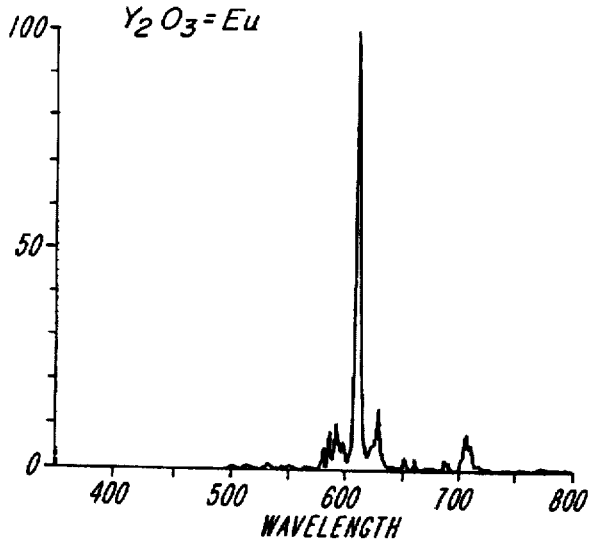
FIGS. 3*a*, 3*b* and 3*c* represent emission spectra, i.e., light intensity in arbitrary units versus wavelengths in nm for luminescent materials useful in the present invention.
Figure 3B:
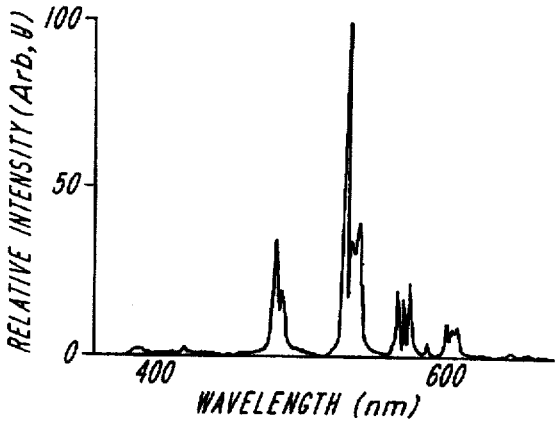
Figure 3C:
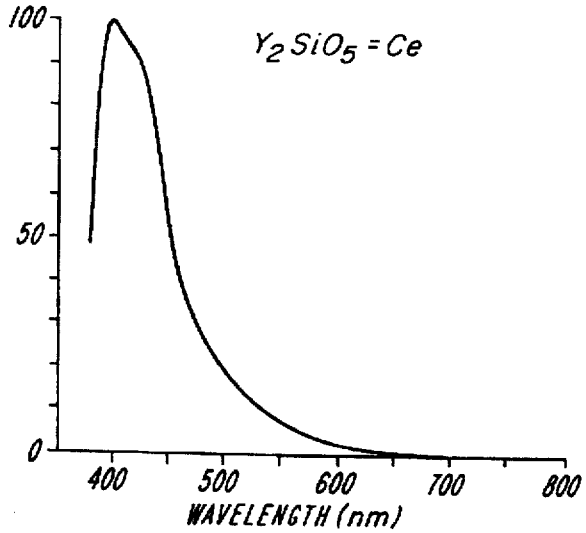

FIGS. 3*a*–3*c* gives examples of phosphors, each emitting a narrow band of visible light. FIG. 3*a* depicts the emission spectrum of $Y_3(Al, Ga)5O_{12}$:Tb emitting green light of about 555 nm. FIG. 3*b* depicts the emission spectrum of $Y_2O_3$:Eu emitting red light at about 612 nm. FIG. 3*c* depicts the emission spectrum of $Y_2SiO_5$:Ce emitting blue light at about 415 nm.

Other process parameters of the illustrated sol-gel embodiment comprise:

| Specific Chemicals For Host, Dopants And Solvents: | |
|---|---|
| For the Blue Phosphor: $Y_2SiO_5$:Ce | |
| Lattice: | Dopant |
| Tetraethylorthosilicate | |
| Yttrium acetylacetonate | Cerium acetylacetonate |
| (Yttrium 2,4-pentanedionate) | (Cerium 2,4-pentanedionate) |
| or use: | or use: |
| Yttrium nitrate | cerium nitrate |
| Yttrium chloride | cerium chloride |
| Yttrium sulfate | cerium sulfate |
| Yttrium oxalate | cerium isopropoxide |
| | $[Ce(OC_3H_7)_4(CH_3)_2CHOH]$ |
| For the Red Phosphor: $Y_2O_3$:Eu | |
| Yttrium acetylacetonate: | Europium acetylactonate |
| (Yttrium 2,4-pentanedionate) | (Europium 2,4-pentanedionate) |
| or use: | or use: |
| Yttrium nitrate | Europium nitrate |
| Yttrium chloride | Europium chloride |
| Yttrium sulfate | Europium sulfate |
| Yttrium oxalate | Europium oxalate |

-continued

| Specific Chemicals For Host, Dopants And Solvents: | |
|---|---|
| | Europium (Thd)3-[Eu(C11H1902)3] |
| For the Green Phosphor: $Y_{3(Al,Ga)5O12:tb}$ | |
| Yttrium acetylacetonate: | Terbium acetylacetonate |
| (Yttrium 2,4-pentanedionate) | (Terbium 2,4-pentanedionate) |
| or use: | or use: |
| Yttrium nitrate | Terbium nitrate |
| Yttrium chloride | Terbium chloride |
| Yttrium sulfate | Terbium sulfate |
| Yttrium oxalate | Terbium oxalate |
| Aluminum acetylacetonate | |
| (Aluminum 2,4-pentanedionate) | |
| Aluminum chloride | |
| Aluminum nitrate | |
| Aluminum sulfate | |
| Aluminum oxalate | |
| Gallium isopropoxide | |
| or use: | |
| Gallium chloride | |
| Gallium nitrate | |
| Gallium sulfate | |
| Gallium oxalate | |

In all cases, the solvent can be pure alcohol, e.g., pure ethanol.

General Procedure:

Dissolve anhydrous salts such as Yttrium chloride ($YCl_3$) in pure ethanol. Add a known quantity of potassium to ethanol and make potassium ethoxide, $KOC_2H_5$. Mix this with $YCl_3$ in ethanol and stir. Under refluxing, a clear solution of yttrium ethoxide and a precipitate of potassium chloride is obtained. The dopant Eu can similarly be added to the Yttrium chloride in ethanol at first and this reaction would form Yttrium europium ethoxides. The ethoxides can then be hydrolyzed by adding a solution of ammonia at room temperature. These products are separated and can then be deposited by various means outlined earlier.

The deposited film can then be heated by such means as rapid thermal annealing (RTA) or laser annealing. A Varian RTP 8000 can be used for RTA and a ND:YAG laser emitting at 1.06 micrometers can be used for laser annealing. A thin metal film, e.g., Au—Pd may be necessary for the second case to help absorb the laser energy. The metal film can subsequently be etched off by dry or chemical means.

The annealing times can be short, on the order of seconds or minutes. In addition, the laser can be used to pattern lines of individual pixels both circular and elongated.

The same basic procedure needs to be followed for the other phosphors. Though only three are actually named here, it should be appreciated that most other phosphors can be prepared using this technique.

Any type of depositing is acceptable, e.g., dipping, screen print, spin coating or meniscus coating after dipping the transparent substrate into the gelated solution. Furthermore, any procedure for removing the organics at low temperatures is acceptable.

Referring now to FIG. 4, a phosphor screen 16 is shown as a part of a field emission display, organized in picture elements or pixels 22. Each pixel 22 is spatially related to a cold cathode emission site. According to a specific application of the present invention, the cathode structure consists of a substrate 11, a plurality of emission sites 13, an insulating layer 14, and a gate structure of 15. Appropriate voltage potentials are connected from a source 20 to the cathode structure 21 and the phosphor screen anode 16 to create electron beams 17, as is known to one of ordinary skill in this art. Large area displays employ spacers 18 to withstand the atmospheric pressure on the vacuum device. In small area displays, such spacers 18 are not needed.

As further seen in FIG. 4, the phosphor screen 16 is organized in a pattern of picture elements 22, rather than having a continuous coating. By means of the present invention, a thin film of phosphor dots 19 is provided on the glass substrate, wherein the phosphor dots 19 are uniform and homogeneous within each pixel 22, the plurality of pixels 22 forming a prescribed raster. The raster of the pixel elements 22 is very accurate and conforms with the raster of color cathode emission sites formed on the substrate 11.

The present invention provides for two different ways to structure the thin film 19 into pixels. In one approach the thin film 19 is selectively applied and non-selectively annealed. In another approach, the thin film 19 is continuously applied and selectively cured. Both ways use the sol-gel method according to the present invention and avoid deposition masks.

The first method of making the screen, according to the present invention, is to print one color in a screen process. The screen process is repeated with three colors, if a full-color screen is manufactured rather than a monochrome screen. Printing a color means that the sol-gel, which has been prepared as a solution of the organic precursor and the luminescent dopant in a common solvent, is deposited on a transparent substrate using a technique such as screen printing. After drying, in order to dry off the solvent, a rapid annealing is applied. For example, "rapid thermal processing" (RTP) is acceptable. Rapid annealing drives off the remainder of the solvent and the organic precursor causing the homogeneously coated phosphor to remain on the transparent.

According to an alternative embodiment of the present invention, a uniform coating of one color is applied. This uniform coating is selectively cured by rastering a laser spot along a predetermined pattern. The laser raster is composed of very thin lines, resulting in high definition and resolution of the pixels. Phosphor which is not cured by the laser is subsequently washed off. A solvent such as acetone is employed to wash off the sol-gel which has not been touched by the laser. If said pixel elements of said phosphor screens are organized in triads of three colors (green, red and blue), a second color is applied and cured by the laser, and then a third color is laid and cured.

The sol-gel process is applicable to both approaches: directly printing the desired pattern of phosphor on the transparent substrate or laser processing of a continuous film to a patterned solid layer. As patterned irradiation by a laser is used, for example, both approaches eliminate deposition masks as needed in the lithographic patterning of a continuous film.

All of the publications cited herein are hereby incorporated by reference as set forth in their entirety. While the particular process as herein shown and disclosed in detail is fully capable of obtaining the objects and advantages herein before stated, it is to be understood that is merely illustrative of the presently preferred embodiments of the invention and that no limitations are intended regarding the details of the construction or design herein shown other than as mentioned in the appended claims.

One having ordinary skill in the art will realize that even though a field emission display was used as an illustrative example, the process is equally applicable to other vacuum displays, such as flat panel displays, cathode ray tubes, front graphical vacuum fluorescent displays, ELDs and plasma displays.

We claim:

1. A method for forming phosphor screens, comprising the steps of:

(a) applying a thin film coating of a gel containing at least an organo-metallic precursor and luminescent dopant to a transparent substrate, with the organo-metallic precursor having an organic potion and a metallic portion: and (b) annealing the gel at the substrate between 200°–500° C. to remove the organic portion from the metallic portion to provide a luminescent surface on the substrate.

2. A method as in claim 1 wherein said step of removing said organic portion comprises thermal annealing.

3. A method as in claim 1 wherein said phosphor screen receives a homogeneous coating of said luminescent phosphor on said transparent substrate.

4. A method as in claim 3 wherein said luminescent dopant leads to a monochrome phosphor material resulting in a monochrome phosphor screen.

5. A method as in claim 3 wherein said homogeneous coating comprises more than one phosphor material.

6. A method as in claim 1 wherein said coating comprises screen printing a pattern of thin dots on the transparent substrate.

7. A method as in claim 6 wherein said step of removing said organic portion comprises thermal annealing.

8. A method as in claim 7 wherein said screen-printed pattern forms a raster of picture elements on said transparent substrate useful as a high-resolution faceplate of a display.

9. A method as in claim 1, wherein said step of removing said organic residue includes curing at least one dot of a pattern of dots and removing the noncured portions of the thin film.

10. A method as in claim 9, wherein curing includes application of energy from a curing source to at least one dot in a pattern of dots.

11. A method as in claim 10 wherein said cured dots form an accurate raster of picture elements on said transparent substrate useful as a high-resolution faceplate of a display.

12. A method as in claim 1 wherein said transparent substrate comprises a conductive transparent electrode.

13. A method as in claim 12 wherein said conductive transparent electrode comprises indium-tin-oxide.

14. A method as in claim 12 wherein said conductive transparent electrode comprises indium oxide.

* * * * *